United States Patent [19]

Lüke

[11] Patent Number: 4,851,013

[45] Date of Patent: Jul. 25, 1989

[54] GASIFICATION PROCESS

[75] Inventor: Hans-Wolfgang Lüke, Hamburg, Fed. Rep. of Germany

[73] Assignee: Shell Oil Company, Houston, Tex.

[21] Appl. No.: 138,777

[22] Filed: Dec. 29, 1987

[51] Int. Cl.[4] ..... C10J 3/00; C10J 3/76

[52] U.S. Cl. ..... 48/203; 48/202; 48/67; 48/DIG. 10; 122/5; 122/449; 252/373; 374/39

[58] Field of Search ..... 48/67, DIG. 10, 202, 48/210, 206, 87, 203; 422/202, 111, 119, 109; 252/373; 236/14; 122/5, 448 R, 449, 452, 504; 110/103, 186; 374/29, 39, 40, 41

[56] References Cited

U.S. PATENT DOCUMENTS

| | | | |
|---|---|---|---|
| 1,338,902 | 5/1920 | Brown | 122/449 |
| 2,369,628 | 2/1945 | Williams | 48/67 |
| 4,278,052 | 7/1981 | Sharp | 122/449 |
| 4,357,305 | 11/1982 | Loo | 48/210 |

*Primary Examiner*—Joye Woodard

[57] ABSTRACT

A process for monitoring the conditions in the reaction zone of a gasifier in a process for the gasification of coal to produce synthesis gas is disclosed, the process being characterized by continual or periodic calculation of the rate of steam production by the heat exchange system of the gasifier, and comparison of the calculated rate with a pre-selected value.

6 Claims, No Drawings

GASIFICATION PROCESS

BACKGROUND OF THE INVENTION

The gasification or partil oxidation of coal requires careful control of temperature, pressure, and feed rates to achieve both maximum efficiency and to avoid upset conditions. Because of the extreme conditions or pressure and temperature, failure to monitor the reaction conditions can lead to catastrophic consequences or to yields of synthesis gas that are unacceptable from a commercial standpoint.

While all parmeters of the process may be scrutinized continuously, determination of a primary indicator which would give a rough but instant reading of the general condition of the process would have great value. The invention concerns such a discovery

SUMMARY OF THE INVENTION

Accordingly, the invention relates to a process for the gasification or partial oxidation of coal in which particulate coal and oxygen are fed to a gasification one comprising at least one gasifier, under conditions to produce synthesis gas. The reaction zone of the gasifier is at least partly surrounded or bounded by a wall or walls through which heat from the reaction is exchanged with water to form steam. Preferably, the gasifier comprises a walled chamber, which, most preferably, comprises a multiplicity of heat exchange tubes which compose, partly compose or surround the wall or walls bounding the reaction one, through which wall or walls water is passed for removing heat from the partial oxidation of the coal, thereby forming steam. According to the invention, the general state of conditions in the reaction one of the gasifier is determined by continually or periodically calculating the rate of steam production in the gasifier or gasification one, preferably in or from the heat exchange tubes of the gasifier, and comparing the rate of steam production with a preselected value. A deviation or change fromthe preselected value will indicate some chnge in reaction zone conditions, and other measurements may then be checked to see the cause of the change. Modest deviations from the pre-selected value may call for, for example, a change in feed rate of the oxygen or coal, or both. A wide deviation from the pre-selected value may indicate an upset stage, calling, for example, for shutdown procedures. In sum, the change of rate of steam make has been determined to be a good indicator of the status of the reaction process. As used herein, the term "preselected value" refers to an acceptable team production rate or value, the avlue or rate being determined either by general engineering principles and calculations based on the design and size of the echanger or tubes, or by a pattern of successful operation of the gasifier in accordance with such principles with concomitant measurement of steam valume or flow rate

DETAILED DESCRIPTION OF THE INVENTION

The design of the gasifier employed is a matter of choice, provided, however, that the system comprises, as mentioned, a walled chamber providing a gasification one and which is adapted to generate steam. As indicated, the chamber preferably comprises a multiplicity of heat exchange tubes. For example, the gasifier may comprise an at least generally cylindrical reaction zone tube surrounded by a plurality or multiplicity of contiguous heat exchange tubes, the heat exchange tubes preferably having their aes oriented in the same diretion as that of the reaction tube, the heat echange tubes being supplied and relieved by inlet and outlet manifolds. alternately, the heat exchange tubes themselves may comprise the chamber "wall", the tubes, e.g., being arranged in a circle and forming a "cylinder", or another desired shape, the portions of the tubes surfaces "inside" the ircle forming a "wall" of the reaction zone. In yet a third case, the reactor inner "wall" may be formed by heat exchange tubes similarly arranged in the desired configuration, e.g. a circle, but the tubes are spaced apart by metal plates which also form a part of the inner "wall" of the reaction zone. The plates, in this case, and the tubes mentioned in the previous cases, may or may not be in contact with other heat exchange tubes, as necessary, to remove the tremendous heat produced by the reaction. Other configurations, wherein the tubes compose or surround the reaction one in a circular or coiled manner, may be employed. The inner "walls" of such vessels may be lined with a refractory to protect the metals employed from overheating or from damage from the reaction products.

The partial combustion of coal to produce synthesis gas, which is substantially carbon monoide and hydrogen, and particulate flyslag, is well known, and a survey of known processes is given in "Ullmanns Enzyklopadie Der Technischen Chemie", vol. 10 (1958), pp. 360–458. Several such processes for the preparation of hydrogen and carbon monoxide, flyslag-containing gases are currently being developed Accordingly, details of the gasification process are related only insofar as is necessary for understanding of the present invention.

In general, the gasification is carried out by partially combusting the coal with a limited volume of oxygen at a temperature normally between 800° C. and 2000° C. If a temperature of between 1050° C. and 2000° C. is employed, the product gas will contain very smallamounts of gaseous side products such as condensable tars, phenols and hydrocarbons. Suitable coals include lignite, bituminous coal, sub-bituminous coal, anthracite coal, and brown coal. Lignites and bituminous coals are preferred. In order to achieve a more rapid and complete gasification, initial pulveriation of the coal is preferred.. Particle sie is preferably selected so that 70% of the solid coal feed can pass a 200 mesh sieve. The gasification is preferably carried out in the presence of oxygen and steam, the purity of the oxygen preferably being at least 90% by volume, nitrogen, carbon dioide and argon being permissible as impurities. If the water content of the coal is too high, the coal should be dried before use. The atmosphere will be maintained reducing by the regulation of the weight ratio of the oxygen to moisture and ash free coal in the range of 0.6 to 11, preferably 0.8 to 1.0. The specific details of the procedures employed form no part of the invention, but those described in U.S Pat. No. 4,350,103 and U.S Pat. No. 4,458,607, incorporated herein by reference, may be employed. Although, in general, it is preferred that the ratio between oxygen and steam be selected so that from 0 to 0.3 parts by volume of steam is present in the reaction one per part by volume of oxygen, the invention is applicable to processes having substantially different ratios of oxygen to steam. The oxygen used is preferably heated before being contacted with the coal, preferably to a temperature of from about 200° to 500° C.

The high temperature at which the gasification is carried out is obtained by reacting the coal with oxygen and steam in a reactor at high velocity A preferred linear velocity of injection is from 10 to 100 meters per second, although higher or lower velocities may be employed. The pressure at which the gasification can be effected may vary between wide limits, preferably being from 1 to 200 bar. Residence times may vary widely; common residence times of from 0.2 to 20 seconds are described, with residence times of from 0.5 to 15 seconds being preferred. The steam generated may be used directly, or may be heated even further to produce higher pressure steam. The steam flow rate from the gasifier, preferably from tubes surrounding the gasification or reaction zone, is measured at a suitable site by devices such as an orifice flow meter or flow nole, and the steam production rate is calculated therefrom, as will be appreciated by those skilled in the art. As indicated, the steam production rate is then compared with a value of steam rate production which is based on experience or design.

After the starting materials have been converted, the reaction product, which comprises hydrogen, carbon monoxide, carbon dioxide, and water, as well as the aforementioned impurities, is removed from the reactor. This gas, which normally has a temperature between 1050° C. and 1800° C., contains the impurities mentioned and flyslag, including carbon-containing solids. In order to permit removal of these materials and impurities from the gas, the reaction product stream should be first quenched and cooled.. A variety of elaborate techniques have been developed for quenching and cooling the gaseous stream, the techniques in the quench zone and primary heat exchange one in general being characteried by use of a quench gas and a boiler in which steam is generated with the aid of the waste heat from the process.

The quenched gas is then subjected to a variety of purification techniques to produce a product gas, commonly called synthesis gas, which has good fuel value as well as being suitable as a feedstock for various processes.

What is claimed is:

1. A process for the gasification of coal comprising feeding particulate coal and oxygen to a gasifier operating under conditions to produce synthesis as, the reaction one of said gasifier being at least partly bounded by a wall or walls through which heat generated in the reaction zone is transferred through to water to form steam, and producing hot synthesis gas, and steam;

monitoring the conditions int he reaction zone by continually or periodically measuring the steam flow rate from the wall or walls of the gasifier and calculating the rate of steam production therefrom, and comparing the calculated rate of steam production with a pre-selected value of steam production rate.

2. A process for the gasification of coal comprising feeding particulate coal and oxygen to a gasifier having a reaction zone operating under conditions to produce synthesis gas, the gasifier comprising a walled chamber comprising a multiplicity of heat exchange tubes composing, partly composing, or surrounding the wall or walls bounding said reaction one, water being passed through said tubes to remove heat from the oidation of said coal to form steam, and producing synthesis gas and steam, monitoring the conditions in the reaction one by continually or periodically measuring the steam flow rate from the heat exchange tubes of the gasifier and calculating the rate of steam production therefrom, and comparing the calculated rate of steam production with a pre-selected value of stream production.

3. The process of claim 2 wherein, in response to a deviation of the calculated rate of steam production from the pre-selected value of steam production rate, the rate of feed of oxygen to the reaction one is changed.

4. The process of claim 2 wherein, in response to a deviation of the calculated rate of steam production from the pre-selected value of steam production rate, the rate of feed of coal to the reaction one is changed.

5. The process of claim 2 wherein, in response to a deviation of the calculated rate of steam production from the pre-selected value of steam production rate, the rate of feed of oxygen and coal to the reaction zone is changed.

6. The process of claim 2 wherein the coal is dried before feeding to the reaction zone.

* * * * *